US009883317B2

(12) United States Patent
Yuyama et al.

(10) Patent No.: US 9,883,317 B2
(45) Date of Patent: Jan. 30, 2018

(54) AUDIO SIGNAL PROCESSING APPARATUS

(71) Applicant: Yamaha Corporation, Hamamatsu-shi, Shizuoka-ken (JP)

(72) Inventors: Yuta Yuyama, Hamamatsu (JP); Ryotaro Aoki, Hamamatsu (JP); Masaya Kano, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 123 days.

(21) Appl. No.: 15/001,446

(22) Filed: Jan. 20, 2016

(65) Prior Publication Data

US 2016/0212563 A1 Jul. 21, 2016

(30) Foreign Application Priority Data

Jan. 20, 2015 (JP) ..... 2015-008305
Jan. 20, 2015 (JP) ..... 2015-008306
Jan. 20, 2015 (JP) ..... 2015-008307

(51) Int. Cl.
*H04R 5/02* (2006.01)
*H04S 7/00* (2006.01)
*H04S 3/00* (2006.01)

(52) U.S. Cl.
CPC ..... *H04S 7/303* (2013.01); *H04S 3/008* (2013.01); *H04S 7/30* (2013.01); *H04S 2400/01* (2013.01); *H04S 2400/11* (2013.01); *H04S 2420/01* (2013.01)

(58) Field of Classification Search
CPC . H04S 7/308; H04S 3/008; H04S 7/30; H04S 2400/01; H04S 2400/11; H04S 2420/01
USPC ..... 381/307
See application file for complete search history.

(56) References Cited

U.S. PATENT DOCUMENTS 6,477,255 B1 * 11/2002 Yoshida ..... H04R 5/02 381/302
2002/0027995 A1 3/2002 Kanai et al.
2002/0057806 A1 5/2002 Hasebe
2003/0007648 A1 1/2003 Currell
2005/0271215 A1 * 12/2005 Kulkarni ..... H04S 5/00 381/18
2012/0057715 A1 * 3/2012 Johnston ..... G10L 19/008 381/63

FOREIGN PATENT DOCUMENTS

EP 1 814 360 A2 8/2007
JP 2001-186599 A 7/2001

OTHER PUBLICATIONS

European Office Action issued in counterpart European Application No. 16151918.6 dated Jun. 9, 2017 (Seven (7) pages).

* cited by examiner

*Primary Examiner* — Quynh Nguyen
(74) *Attorney, Agent, or Firm* — Crowell & Moring LLP

(57) ABSTRACT

An audio signal processing apparatus includes an input unit configured to receive input of audio signals of a plurality of channels, an obtaining unit configured to obtain position information of a sound source, a sound field effect sound generating unit configured to generate a sound field effect sound by individually imparting a sound field effect to an audio signal of each of the channels, and a control unit configured to control the sound field effect to be imparted in the sound field effect sound generating unit, based on the position information.

16 Claims, 14 Drawing Sheets

Low

| | L | R | C | SL | SR |
|---|---|---|---|---|---|
| L | | | | ○ | |
| R | | | | | |
| C | | | | | |
| SL | ○ | | | | |
| SR | | | | | |

Mid

| | L | R | C | SL | SR |
|---|---|---|---|---|---|
| L | | | | | |
| R | | | | | |
| C | | | | | |
| SL | | | | | |
| SR | | | | | |

High

| | L | R | C | SL | SR |
|---|---|---|---|---|---|
| L | | | | | |
| R | | | | | |
| C | | | | | |
| SL | | | | | |
| SR | | | | | |

Low

| L | R | C | SL | SR |
|---|---|---|---|---|
| ○ | | | ○ | |

Mid

| L | R | C | SL | SR |
|---|---|---|---|---|
| | | ○ | | |

High

| L | R | C | SL | SR |
|---|---|---|---|---|
| | | | | |

AUDIO SIGNAL PROCESSING APPARATUS

CROSS REFERENCE

This Nonprovisional application claims priority under 35 U.S.C. §119(a) on Patent Applications Nos. 2015-008305, 2015-008306 and 2015-008307, all filed in Japan on Jan. 20, 2015, each of the entire contents of which are hereby incorporated by reference.

BACKGROUND

1. Field

Some preferred embodiments of the present invention relate to an audio signal processing apparatus that performs various processes to an audio signal.

2. Description of the Related Art

Conventionally, sound field supporting devices that form a desired sound field in a listening environment have been known (see JP 2001-186599 A, for example). The sound field supporting devices generate a pseudo reflected sound (sound field effect sound) by combining audio signals of a plurality of channels and convolving a predetermined parameter to the combined audio signals.

On the other hand, in recent years, a sound image localization method by object information imparted to content has been widely used. The object information includes information indicating a position of an object. The object is a term corresponding to a "sound source" in the sound image localization method using object information.

Sound field effects, however, have not been optimized for the sound image localization method by the object information. For example, since the sound field effects are preferably reduced in a case in which the type of the sound source is a sound such as speech, a front signal or a surround signal that is likely to contain a great number of components such as music has a high contribution rate while a center signal that is likely to contain a great number of components such as speech has a low contribution rate.

In such a state, in a case in which an object moves from the front to the back, for example, as a sound image localization position of the object changes from the front to the back, the sound field effects may be drastically increased in some cases.

Moreover, in the sound image localization method by the object information, the audio signals that have been channel distributed based on the listening environment (speaker arrangement mode) are only input and the position information itself of the original object may not be obtained in other cases.

Furthermore, in a case in which content is recorded in a small concert hall, for example, and the sound field effect of a large concert hall as the listening environment is set to be imparted to the content, an indirect sound is spread while the position of a direct sound (each sound source) is not changed.

In view of the foregoing, some preferred embodiments of the present invention are directed to provide an audio signal processing apparatus that forms an optimum sound field for each object.

In addition, other preferred embodiments of the present invention are directed to provide an audio signal processing apparatus that estimates position information of an object contained in content.

Moreover, some other preferred embodiments of the present invention are directed to provide an audio signal processing apparatus that imparts a proper sound image position.

SUMMARY

An audio signal processing apparatus according to preferred embodiments of the present invention includes an input unit configured to receive input of content containing audio signals of a plurality of channels, an obtaining unit configured to obtain position information of a sound source contained in the content, and a sound field effect sound generating unit configured to generate a sound field effect sound by individually imparting a sound field effect to an audio signal of each of the channels.

Then, the audio signal processing apparatus also includes a control unit configured to control the sound field effect to be imparted in the sound field effect sound generating unit, based on the position information.

The sound field effect sound generating unit imparts the sound field effect, for example, by convolving an individual filter coefficient according to the position information to the audio signal of each of the channels. Alternatively, the sound field effect sound generating unit may preferably generate the sound field effect sound by combining the audio signals of the channels with a predetermined gain, and the control unit may preferably control the gain of each of the channels in the sound field effect sound generating unit based on the position information.

The audio signal processing apparatus does not fix a rate of contribution to the sound field effect sound of each of the channels but dynamically sets the rate of contribution of each of the channels according to change in position of an object, so that an optimum sound field effect sound corresponding to the movement of the object is generated.

For example, in a case in which an object is positioned in front of a listening position, the contribution rate of a front channel is set to be high, and, as the object moves backward, the contribution rate of the front channel is set to be low and the contribution rate of a surround channel is set to be high. Thus, even when the sound image localization position of the object changes from the front to the back, the sound effect is not drastically increased.

According to preferred embodiments of the present invention, an optimum sound field can be formed for each object.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

A first preferred embodiment of the present invention relates to an audio signal processing apparatus including an input unit configured to receive input of content containing audio signals of a plurality of channels, an obtaining unit configured to obtain position information of a sound source contained in the content, a sound field effect sound generating unit configured to generate a sound field effect sound by individually imparting a sound field effect to an audio signal of each of the channels, and a control unit configured to control the sound field effect to be imparted in the sound field effect sound generating unit, based on the position information.

It is to be noted that the sound field effect sound generating unit may preferably include a first sound field effect sound generating unit and a second sound field effect sound generating unit, the first sound field effect sound generating unit may preferably perform a process of generating the sound field effect sound by individually imparting the sound field effect to the audio signal of each of the channels based on a predetermined parameter, and the second sound field effect sound generating unit may preferably perform a process of individually imparting the sound field effect to the audio signal of each of the channels based on a control of the control unit.

In such a case, while the sound field effect sound obtained by fixing the contribution rate of each of the channels is generated as in the conventional art, the sound field effect sound obtained by setting an optimum contribution rate corresponding to the position for each object is generated.

In addition, the obtaining unit may preferably obtain the position information of the sound source for each band, and the control unit, based on the position information of the sound source for each band, may preferably set a parameter in the sound field effect sound generating unit.

For example, in case of an object of which the main component is in a low frequency band, the sound field effect sound is generated by a parameter (filter coefficient) prepared for the low frequency band.

Moreover, the obtaining unit may further obtain information indicating the type of the sound source, and the control unit, based on the information indicating the type of the sound source, can also preferably set a different gain to the type of the sound source.

For example, in a case in which the object is speech, the contribution rate of the channel corresponding to the object of the speech is kept low. Accordingly, for example, even when content includes a speaker who moves from the front to the back, the sound of the speaker does not unnecessarily resonate and a proper sound field can be formed.

Figure 1:
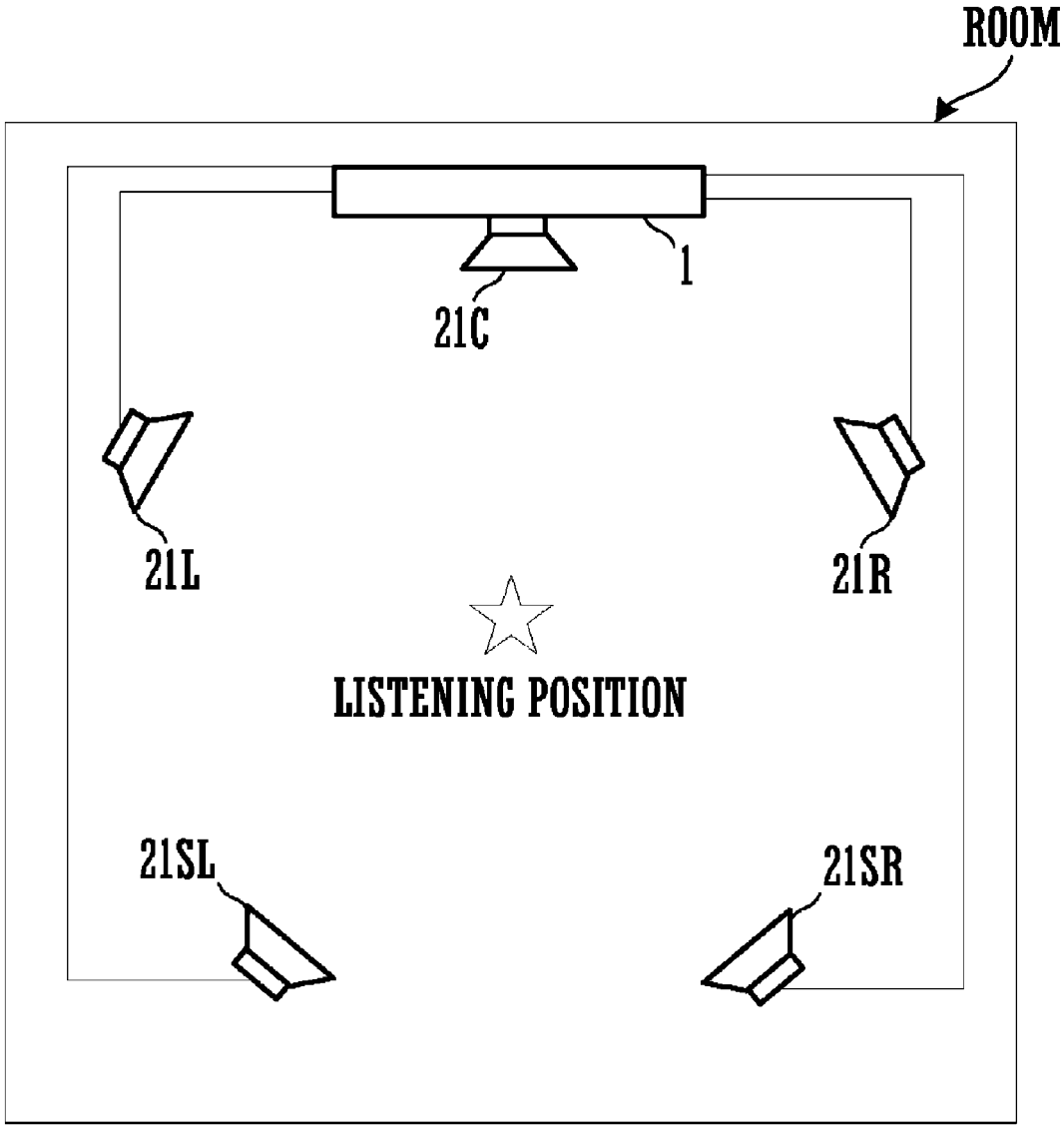
FIG. 1 is a view illustrating a frame format of a listening environment.
Figure 2:
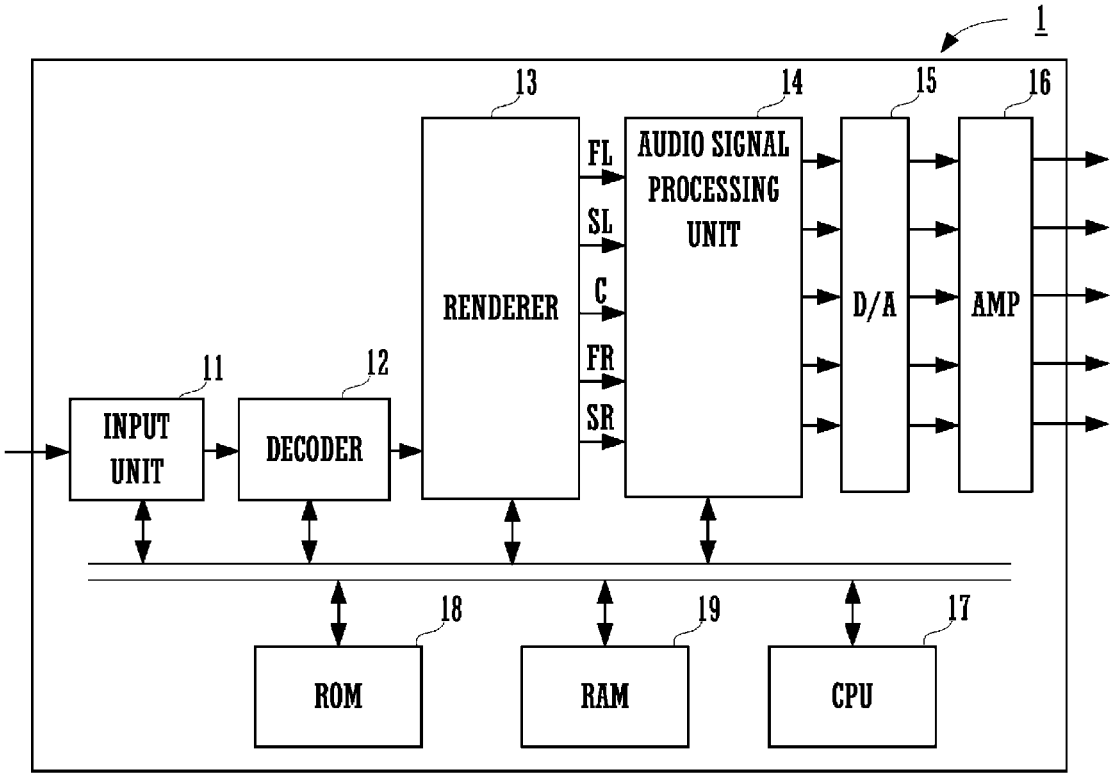
FIG. 2 is a block diagram of an audio signal processing apparatus according to a first preferred embodiment.

FIG. 1 is a view illustrating a frame format of a listening environment according to a first preferred embodiment and FIG. 2 is a block diagram of an audio signal processing apparatus 1 according to the first preferred embodiment. In the first preferred embodiment, an example, in a room square shaped in a plan view, shows a listening environment in which the central position of the room is a listening position. Around the listening position, a plurality of speakers (five speakers of a speaker 21L, a speaker 21R, a speaker 21C, a speaker 21SL, and a speaker 21SR in this example) are installed. The speaker 21L is installed on the front left side of the listening position, the speaker 21R is installed on the front right side of the listening position, the speaker 21C is installed in the front center of the listening position, the speaker 21SL is installed on the back left side of the listening position, and the speaker 21SR is installed on the back right side of the listening position. The speaker 21L, the speaker 21R, the speaker 21C, the speaker 21SL, and the speaker 21SR are individually connected to an audio signal processing apparatus 1.

The audio signal processing apparatus 1 includes an input unit 11, a decoder 12, a renderer 13, an audio signal processing unit 14, a D/A converter 15, an amplifier (AMP) 16, a CPU 17, a ROM 18, and a RAM 19.

The CPU 17 reads an operating program (firmware) stored in the ROM 18 to the RAM 19 and collectively controls the audio signal processing apparatus 1.

The input unit 11 has an interface such as an HDMI (registered trademark). The input unit 11 receives input of content data from a player and the like and outputs the data to the decoder 12. It should be noted that the input unit 11 may receive not only the input of the content data but also the input of a digital audio signal or an analog audio signal. The input unit 11, in a case of receiving the input of an analog audio signal, converts the analog audio signal into a digital audio signal.

The decoder 12 is a DSP, for example, decodes the content data, and extracts an audio signal from the content data. The decoder 12, in a case of receiving the input of the digital audio signal from the input unit 11, outputs the digital audio signal as it is to the renderer 13 provided in the subsequent stage. It is to be noted that, in the present preferred embodiment, an audio signal is all described as a digital audio signal unless otherwise stated.

The decoder 12, in a case in which the input content data is supported in an object-based system, extracts object information. The object-based system stores an object (sound source) contained in content as an individual audio signal. In the object-based system, the renderer 13 provided in the subsequent stage distributes the audio signal of the object to the audio signal of each of the channels to perform a sound image localization process (in each object). Therefore, the object information includes information such as the position information of each object and the level.

The renderer 13 is a DSP, for example, and performs the sound image localization process based on the position information of each object contained in the object information. In other words, the renderer 13 distributes the audio signal of each object that is output from the decoder 12 to the audio signal of each of the channels with a predetermined gain so that a sound image is localized at a position corresponding to the position information of each object. In this manner, an audio signal of a channel-based system is generated. The generated audio signal of each of the channels is output to the audio signal processing unit 14.

The audio signal processing unit 14 is a DSP, for example, and performs a process of imparting a predetermined sound field effect to the input audio signal of each of the channels, according to the setting of the CPU 17.

The sound field effect includes a pseudo reflected sound to be generated from the input audio signal, for example. The generated pseudo reflected sound is added to the original audio signal and is output.

Figure 3:
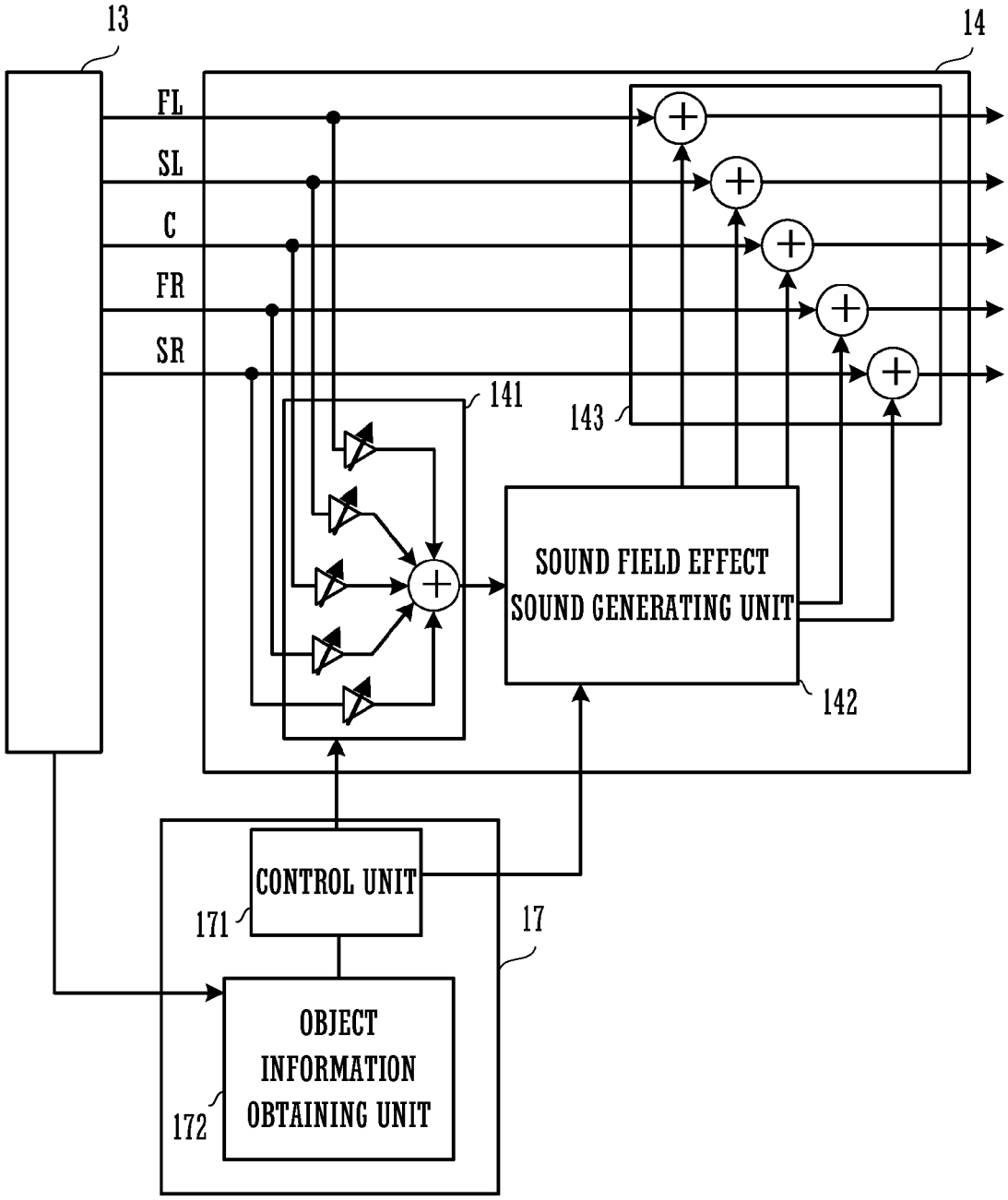
FIG. 3 is a block diagram of a functional configuration of a DSP and a CPU.

FIG. 3 is a block diagram of a functional configuration of the audio signal processing unit 14 and the CPU 17. The audio signal processing unit 14, as a function, includes an adding processing unit 141, a sound field effect sound generating unit 142, and an adding processing unit 143.

The adding processing unit 141 combines the audio signals of the channels with a predetermined gain and mixes the audio signals down to monaural signals. The gain of each of the channels is set by the control unit 171 included in the CPU 17. In general, since the sound field effects are preferably reduced in a case in which the type of the sound source is a sound such as speech, the gain of the front channel or the surround channel that is likely to contain a great number of components such as music is set to be high while the gain of a center channel that is likely to contain a great number of components such as speech is set to be low.

The sound field effect sound generating unit 142 is an FIR filter, for example, and generates a pseudo reflected sound by convolving a parameter (filter coefficient) indicating a predetermined impulse response to the input audio signal. In addition, the sound field effect sound generating unit 142 performs a process of distributing the generated pseudo reflected sound to each of the channels. The filter coefficient and the distribution ratio are set by the control unit 171 included in the CPU 17.

The CPU 17, as a function, includes the control unit 171 and an object information obtaining unit 172. The control unit 171, based on sound field effect information stored in the ROM 18, sets the filter coefficient, the distribution ratio to each of the channels, and the like, to the sound field effect sound generating unit 142.

The sound field effect information includes an impulse response of a group of reflected sounds generated in an acoustic space and information indicating a position of the sound source of the group of reflected sounds. For example, the speaker 21L and the speaker 21SL are supplied with the audio signals by a predetermined delay amount and a predetermined gain ratio (1:1, for example), which can generate a pseudo reflected sound on the left side of the listening position. The sound field effect information includes the setting of a presence sound field for producing a sound field on the front upper side and the setting of a surround sound field for producing a sound field on the surround side. The sound field effect information to be selected may be fixed to one piece of the information in the audio signal processing apparatus 1 or, after a user desires and specifies an acoustic space such as a movie theater or a concert hall so that the acoustic space specified by the user may be received, the sound field effect information corresponding to the received acoustic space may be selected.

As described above, the sound field effect sound is generated and added to each of the channels in the adding processing unit 141. Thereafter, the audio signal of each of the channels is converted into an analog signal in the D/A converter 15 and output to each of the speakers after being amplified by the amplifier 16. Accordingly, a sound field that imitates a predetermined acoustic space such as a concert hall is formed around the listening position.

Then, the audio signal processing apparatus 1 according to the preferred embodiment causes the object information obtaining unit 172 to obtain the object information extracted by the decoder 12 and forms an optimum sound field for each object. The control unit 171, based on the position information contained in the object information obtained by the object information obtaining unit 172, sets the gain of each of the channels of the adding processing unit 141. Thus, the control unit 171 controls the gain of each of the channels in the sound field effect sound generating unit 142.

An example assumes that an object is in front of the listening position at time t=1, the object moves close to the listening position at time t=2 and moves behind the listening position at time t=3. The control unit 171, at time t=1, sets the gain of the front channel to a maximum value and sets the gain of the surround channel of the adding processing unit 141 to a minimum value. The control unit 171, at time t=2, sets the gain of front channel and the gain of the surround channel of the adding processing unit 141 to be approximately equal to each other. Thereafter, the control unit 171, at time t=3, sets the gain of the surround channel of the adding processing unit 141 to a maximum value and sets the gain of the front channel to a minimum value.

In such a manner, the audio signal processing apparatus 1 causes the gain of each of the channels of the adding processing unit 141 corresponding to a moving object to be dynamically changed and thus can cause a formed sound field to be dynamically changed. Accordingly, a listener can obtain an improved three-dimensional sound field effect.

It should be noted that, while the present preferred embodiment shows an example in which the five speakers of the speaker 21L, the speaker 21R, the speaker 21C, the speaker 21SL, and the speaker 21SR are installed and the audio signals of the five channels are processed in order to make the explanation easier to understand, the number of speakers and the number of the channels are not limited to the example. In practice, a greater number of speakers may preferably be installed at positions of different heights in order to achieve a three-dimensional sound image localization and sound field effect.

It is to be noted that, while, in the above described example, the process of generating a pseudo reflected sound is performed by combining the audio signals of the channels with the gain based on the obtained position information and convolving a parameter (filter coefficient) indicating a predetermined impulse response to the audio signals, a process of imparting the sound field effect may be performed by convolving an individual filter coefficient to the audio signal of each of the channels. In such a case, the ROM 18 stores a plurality of filter coefficients corresponding to the position of an object, and the control unit 171, based on the obtained position information, reads a corresponding filter coefficient from the ROM 18 and sets the filter coefficient to the sound field effect sound generating unit 142. In addition, the control unit 171 may perform a process of combining the audio signals of the channels with the gain based on the obtained position information, reading a corresponding filter coefficient from the ROM 18 based on the obtained position information, and setting the filter coefficient to the sound field effect sound generating unit 142.

Figure 10:
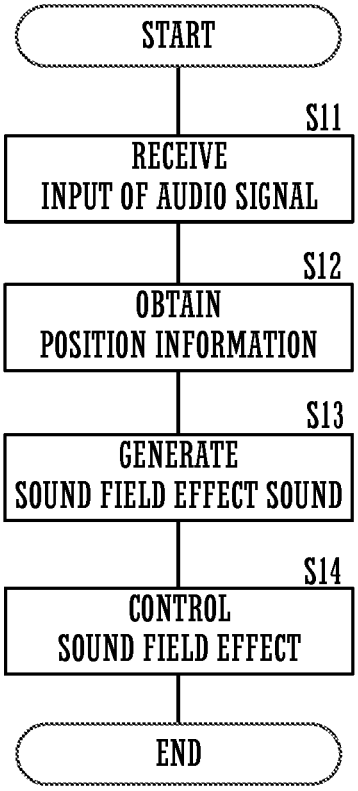
FIG. 10 is a flow chart showing the operation of the audio signal processing apparatus.

FIG. 10 is a flow chart showing the operation of the audio signal processing apparatus. First, the audio signal processing apparatus receives the input of an audio signal (S11). As described above, in a case in which the input unit 11 receives the input of content data from a player and the like, the decoder 12 decodes the content data and extracts an audio signal. The input unit 11, in a case of receiving the input of an analog audio signal, converts the analog audio signal into a digital audio signal. Then, the audio signal processing apparatus obtains position information (object information) (S12) and generates a sound field effect sound by individually imparting a sound field effect to the audio signal of each of the channels (S13). Thereafter, the audio signal processing apparatus, based on the obtained position information, controls the sound field effect by setting the gain of each of the channels (S14).

Second Preferred Embodiment

A second preferred embodiment of the present invention relates to an audio signal processing apparatus including an input unit configured to receive input of audio signals of a plurality of channels, a correlation detecting unit configured to detect a correlation component between the channels, and an obtaining unit configured to obtain the position information of a sound source based on the correlation component detected by the correlation detecting unit.

Figure 4:
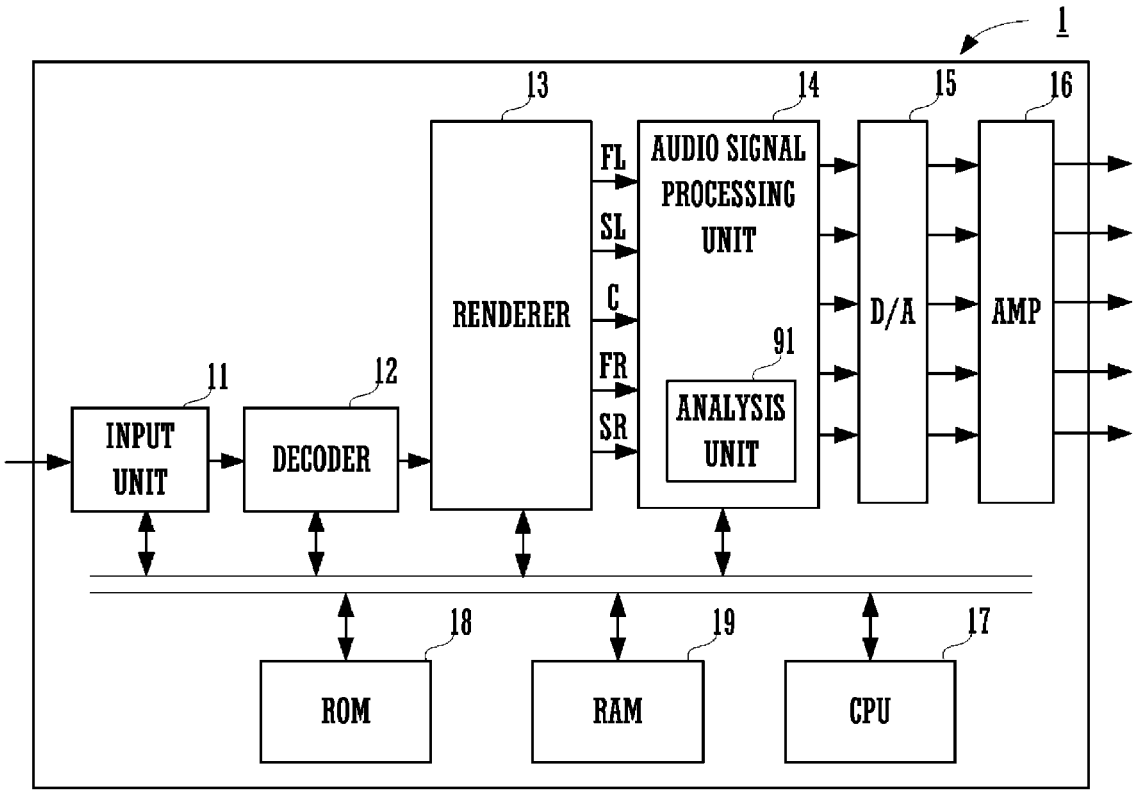
FIG. 4 is a block diagram of a functional configuration of a DSP according to a modification example of the first preferred embodiment.

FIG. 4 is a block diagram of a configuration of an audio signal processing apparatus 1B according to the second preferred embodiment. Like reference numerals are used to refer to components common to the audio signal processing apparatus 1 according to the first preferred embodiment shown in FIG. 2, and the description is omitted. In addition, the listening environment according to the second preferred embodiment is similar to the listening environment according to the first preferred embodiment shown in FIG. 1.

The audio signal processing apparatus 1B includes an audio signal processing unit 14 including a function of an analysis unit 91 in addition to the functions shown in FIG. 3. In practice, the analysis unit 91 is achieved as a different hardware item (DSP) but, for the purpose of the description in the second preferred embodiment, is assumed to be achieved as a function of the audio signal processing unit 14. Moreover, the analysis unit 91 can be achieved by software executed by the CPU 17.

The analysis unit 91, by analyzing the audio signal of each of the channels, extracts the object information contained in content. In other words, the audio signal processing apparatus 1B according to the second preferred embodiment, in a case in which the CPU 17 does not obtain (or cannot obtain) the object information from the decoder 12, estimates the object information by analyzing the audio signal of each of the channels.

Figure 5:
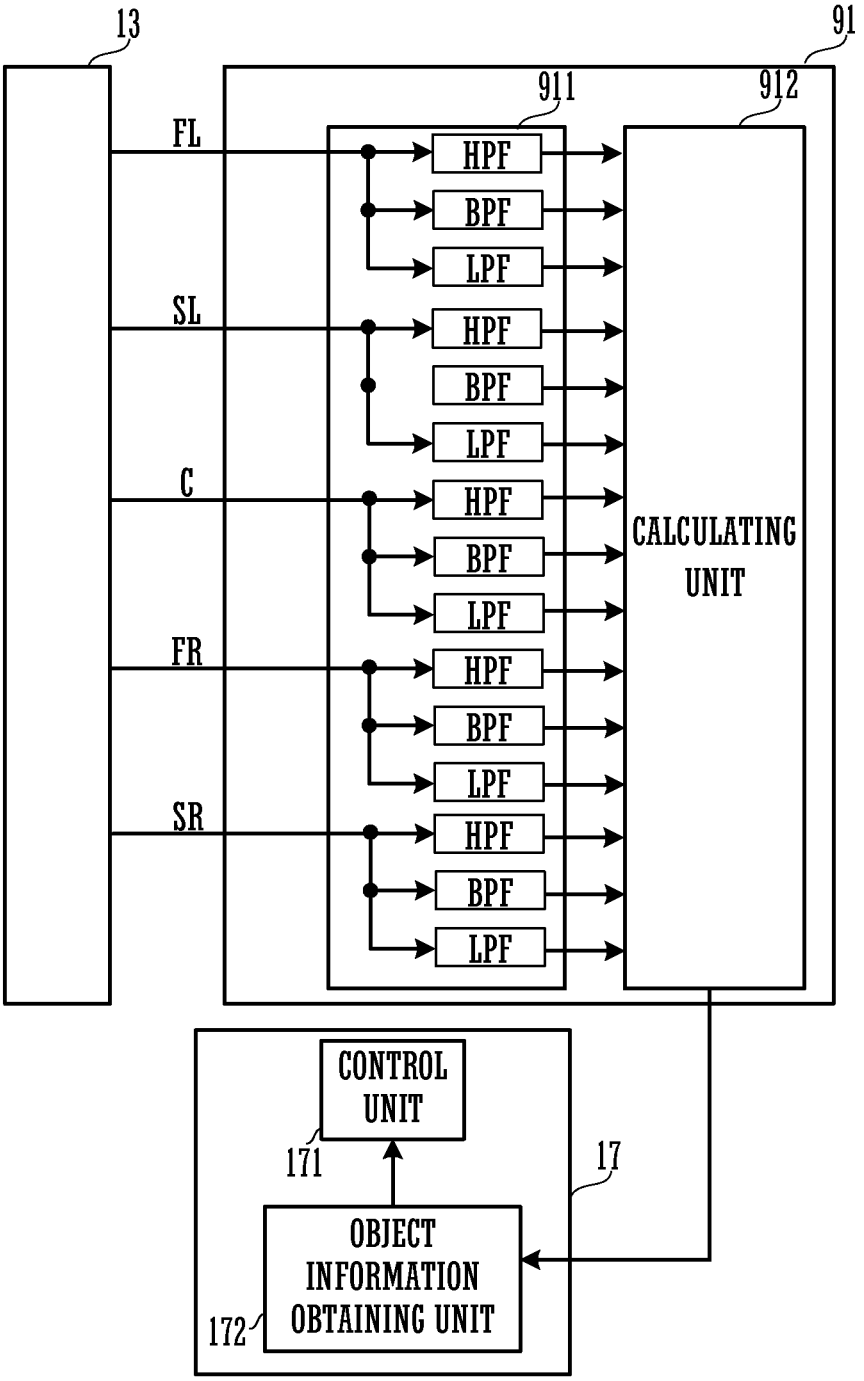
FIG. 5 is a block diagram of a functional configuration of a DSP according to a modification example of a second preferred embodiment.

FIG. 5 is a block diagram of a functional configuration of the analysis unit 91. The analysis unit 91 includes a band dividing unit 911 and a calculating unit 912. The band dividing unit 911 divides the band of the audio signal of each of the channels into a predetermined frequency band. This example shows that the frequency band is divided into three bands: a low frequency band (LPF), a middle frequency band (BPF), and a high frequency band (HPF). However, the band to be divided is not limited to such three frequency bands. The divided audio signal of each of the channels is input to the calculating unit 912.

The calculating unit 912, in each of the divided bands, calculates a mutual correlation value between the channels. The calculated mutual correlation value is input to the object information obtaining unit 172 of the CPU 17. In addition, the calculating unit 912 also functions as a level detecting unit configured to detect the level of the audio signal of each of the channels. The level information of the audio signal of each of the channels is also input to the object information obtaining unit 172.

The object information obtaining unit 172 estimates the position of an object based on the input correlation value and the level information of the audio signal of each of the channels.

Figures 6A, 6B, 6C:
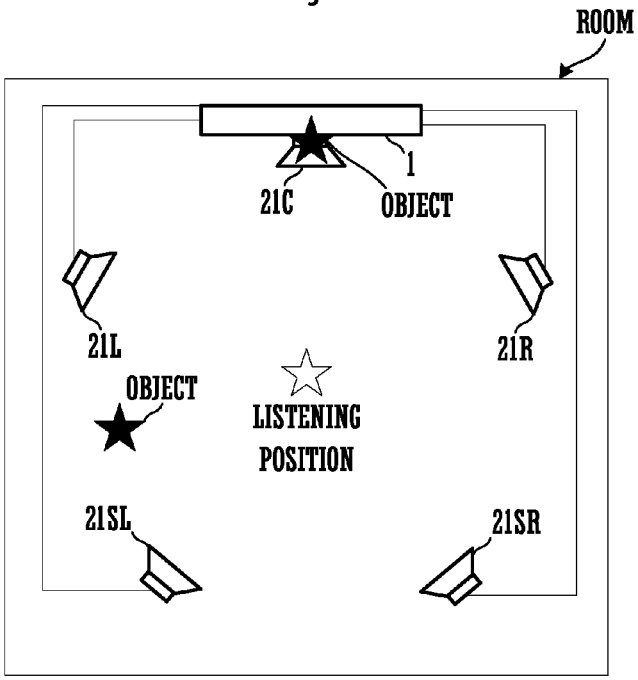
FIG. 6A and FIG. 6B are views illustrating correction between channels.
FIG. 6C is a view illustrating a frame format of a listening environment according to the second preferred embodiment.

For example, in a case in which, as shown in FIG. 6A, a correlation value between the L channel and the SL channel in the low frequency band (Low) is large (exceeds a predetermined threshold value), and, as shown in FIG. 6B, the levels of the L channel and the SL channel in the low frequency band (Low) are high (exceeds a predetermined threshold value), as shown in FIG. 6C, the object is assumed to exist between the speaker 21L and the speaker 21SL.

Moreover, while there are no channels having high correlation in the high frequency band (High), in the C channel in the middle frequency band (Mid), an audio signal at a high level is input. Therefore, as shown in FIG. 6C, another object is assumed to exist close to the speaker 21C.

In such a case, the control unit 171, with respect to a gain to be set to the adding processing unit 141 as shown in FIG. 3, sets the gain of the L channel and the gain of the SL channel to be approximately equal to each other (0.5:0.5) and sets the gain of the C channel to a maximum value (1). The gains of the other channels are set to a minimum value. Accordingly, the sound field effect sound to which an optimum contribution rate corresponding to the position of each object has been set is generated.

However, since the high level signal in the C channel may relate to a sound such as speech, the control unit 171 may preferably set the gain by also referring to information relating to the type of each object. The information relating to the type of the object will be described below.

Additionally, in such a case, the control unit 171 may preferably read sound field effect information set for each of the bands from the ROM 18 and may preferably set an individual parameter (filter coefficient) for each of the bands to the sound field effect sound generating unit 142. For example, reverberation time is set to be short in the low frequency band and to be long in the high frequency band.

It should be noted that the position of the object can be more correctly estimated as the number of channels increases. While this example shows that each of the speakers is arranged at the same height and the correlation values of the audio signals of the five channels are calculated, in practice, a greater number of speakers may preferably be installed at positions of different heights in order to achieve a three-dimensional sound image localization and a sound field effect and the correlation values between the greater number of channels are calculated, so that the position of a sound source can be determined almost uniquely.

It is to be noted that, although the present preferred embodiment shows an example in which the audio signal of each of the channels is divided for each of the bands and the position information of the object is obtained for each of the bands, such a configuration in which the position information of the object is obtained for each of the bands is not essential to the present invention.

FIRST MODIFICATION EXAMPLE

Figure 7:
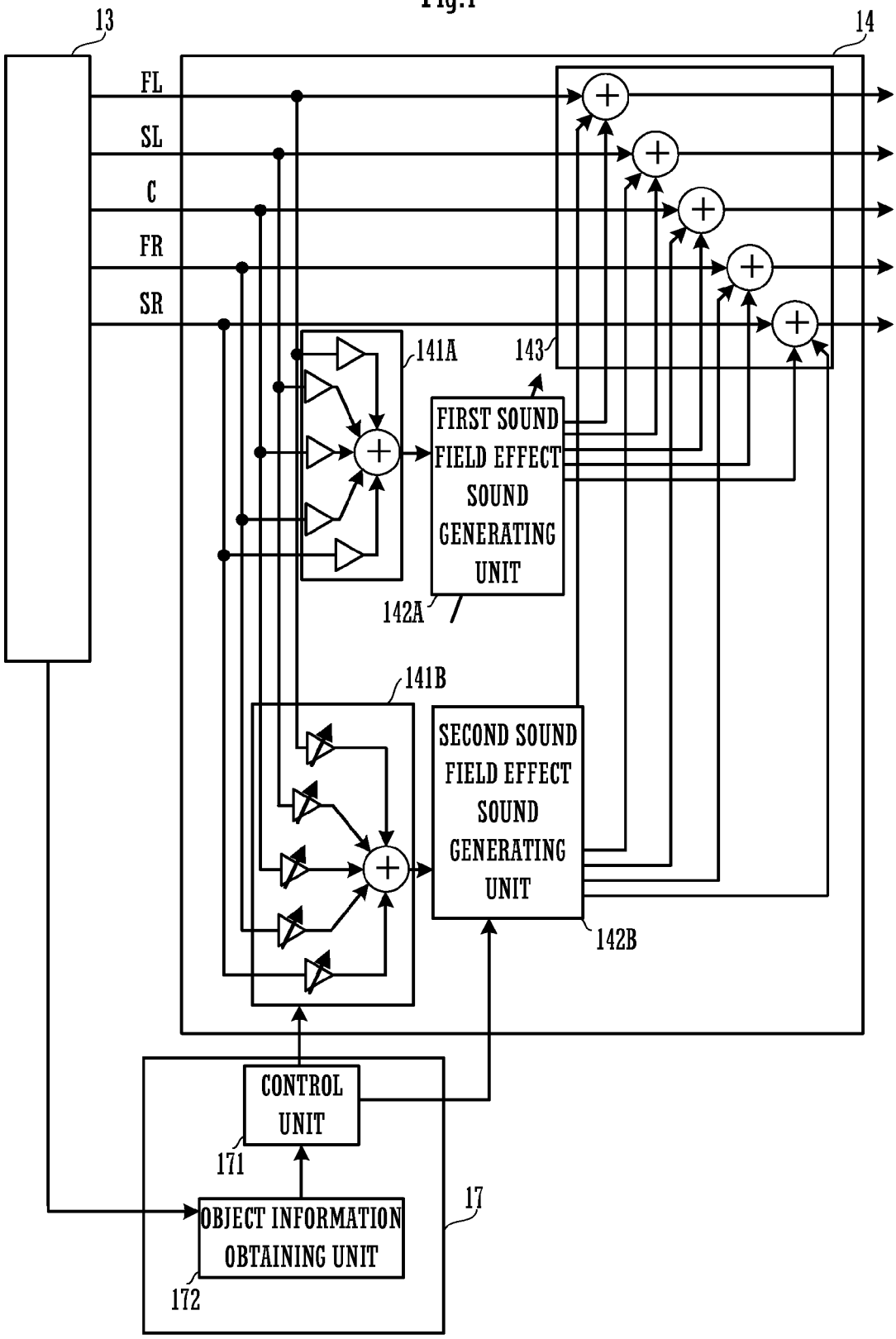
FIG. 7 is a block diagram of a functional configuration of an audio signal processing unit 14 according to a first modification example of the first preferred embodiment (or the second preferred embodiment).

Subsequently, FIG. 7 is a block diagram of a functional configuration of an audio signal processing unit 14 according to a first modification example of the first preferred embodiment (or the second preferred embodiment). The audio signal processing unit 14 according to the first modification example includes an adding processing unit 141A, a first sound field effect sound generating unit 142A, an adding processing unit 141B, a second sound field effect sound generating unit 142B, and an adding processing unit 143. It should be noted that, while the adding processing unit 141B and the second sound field effect sound generating unit 142B are configured to be different hardware (DSP) items in practice, this example, for description, shows that each of the adding processing unit 141B and the second sound field effect sound generating unit 142B is assumed to be achieved as a function of the audio signal processing unit 14.

The adding processing unit 141A combines the audio signals of the channels with a predetermined gain and mixes the combined audio signal to a monaural signal. The gain of each of the channels is fixed. For example, as described above, the gain of the front channel or the surround channel is set to be high while the gain of the center channel is set to be low.

The first sound field effect sound generating unit 142A generates a pseudo reflected sound by convolving a parameter (filter coefficient) indicating a predetermined impulse response to the input audio signal. In addition, the first sound field effect sound generating unit 142A performs a process of distributing the generated pseudo reflected sound to each of the channels. The filter coefficient and the distribution ratio are set by the control unit 171. In the same manner as in the example of FIG. 3, after a user desires and specifies an acoustic space such as a movie theater or a concert hall so that the acoustic space specified by the user may be received, the sound field effect information corresponding to the received acoustic space may be selected.

On the other hand, the control unit 171, based on the position information contained in the object information obtained by the object information obtaining unit 172, sets the gain of each of the channels of the adding processing unit 141B. Thus, the control unit 171 controls the gain of each of the channels in the second sound field effect sound generating unit 142B.

The sound field effect sound generated in the first sound field effect sound generating unit 142A and the sound field effect sound generated in the second sound field effect sound generating unit 142B are each added to the audio signals of each of the channels in the adding processing unit 143.

Therefore, the audio signal processing unit 14 according to the first modification example generates in the conventional manner the sound field effect sound obtained by setting an optimum contribution rate corresponding to the position of each object while generating the sound field effect sound obtained by fixing the contribution rate of each of the channels.

SECOND MODIFICATION EXAMPLE

Subsequently, an audio signal processing apparatus according to a second modification example of the first preferred embodiment (or the second preferred embodiment) will be described. An audio signal processing unit 14 and a CPU 17 according to the second modification example include a functional configuration similar to the configuration as shown in FIG. 3 (or the configuration as shown in FIG. 7). However, an object information obtaining unit 172 according to the second modification example, as object information, obtains information indicating the type of an object in addition to position information.

The information indicating the type of the object is information indicating the type of a sound source such as speech, a musical instrument, and an effect sound. The information indicating the type of the object, in a case of being contained in content data, is extracted by the decoder 12 and can be estimated by the calculating unit 912 included in the analysis unit 91.

For example, the band dividing unit 911 included in the analysis unit 91 extracts the frequency band of a first formant (200 Hz to 500 Hz) and the frequency band of a second formant (2 kHz to 3 kHz) from the input audio signal. If an input signal component includes a large number of components relating to speech or includes only components relating to speech, a greater number of the components of the first formant and the second formant are included in the frequency band than the other frequency bands.

Thus, the object information obtaining unit 172, in the case in which the level of the component of the first formant or the second formant is high compared to the average level of a whole frequency band, determines that the type of the object is speech.

The control unit 171 sets the gain of the adding processing unit 141 (or the adding processing unit 141B) based on the type of the object. For example, as shown in FIG. 6C, in a case in which an object is on the left side of the listening position and the type of the object is speech, the gains of the L channel and the SL channel are set to be low. Alternatively, as shown in FIG. 6C, in a case in which an object is in front of the listening position and the type of the object is speech, the gain of the C channel is set to be low.

THIRD MODIFICATION EXAMPLE

As a third modification example of the second preferred embodiment, an audio signal processing apparatus 1B, by using the estimated object position information, can cause a display unit 92 to display the position of the object. Thus, a user can visually grasp the movement of the object. In a case of content such as a movie, the display unit has already displayed a counterpart to the object as an image in many cases and the displayed image is a subjective view. Accordingly, the audio signal processing apparatus 1B can display the position of the object as an overhead view of which the center is the position of the audio signal processing apparatus 1B, for example.

Figure 11:
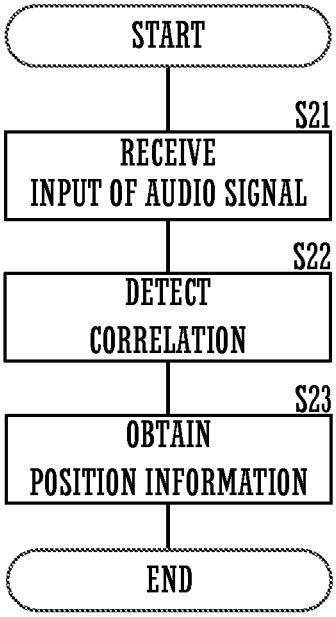
FIG. 11 is a flow chart showing the operation of the audio signal processing apparatus.

FIG. 11 is a flow chart showing the operation of the audio signal processing apparatus. First, the audio signal processing apparatus receives the input of an audio signal (S21). Then, the calculating unit 912 detects a correlation component between the channels (S22). The audio signal processing apparatus obtains position information based on the detected correlation component (S23). The audio signal processing apparatus generates a sound field effect sound by individually imparting a sound field effect to the audio signal of each of the channels (S23).

Third Preferred Embodiment

A third preferred embodiment of the present invention relates to an audio signal processing apparatus including an input unit configured to receive input of audio signals of a plurality of channels; an obtaining unit configured to obtain position information of a sound source; a sound image localization processing unit configured to perform sound image localization of the sound source based on the position information; a receiving unit configured to receive a change command to change a listening environment, and a control unit configured to control a sound image position of the sound image localization processing unit according to the change command that has been received by the receiving unit.

Figure 8A:
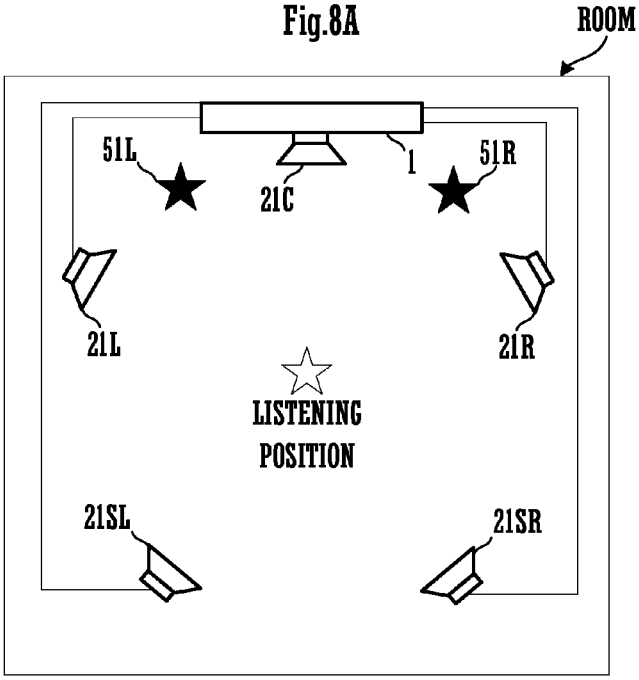
FIG. 8A and FIG. 8B are views illustrating a frame format of a listening environment according to a third preferred embodiment.
Figure 8B:
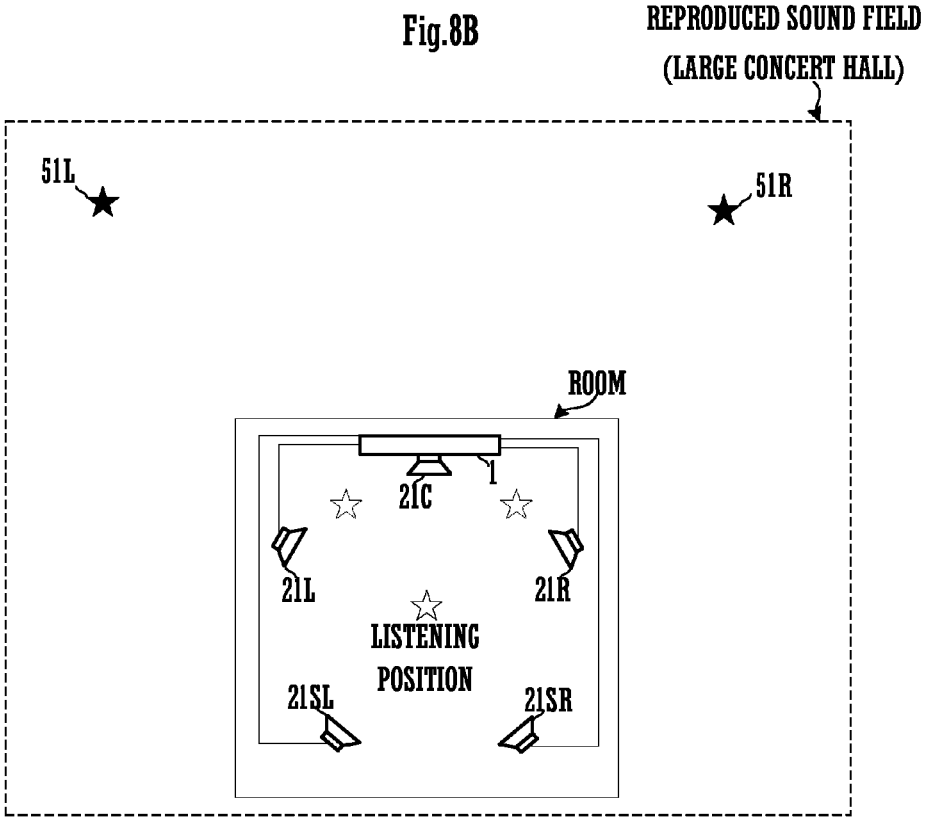
Figure 9:
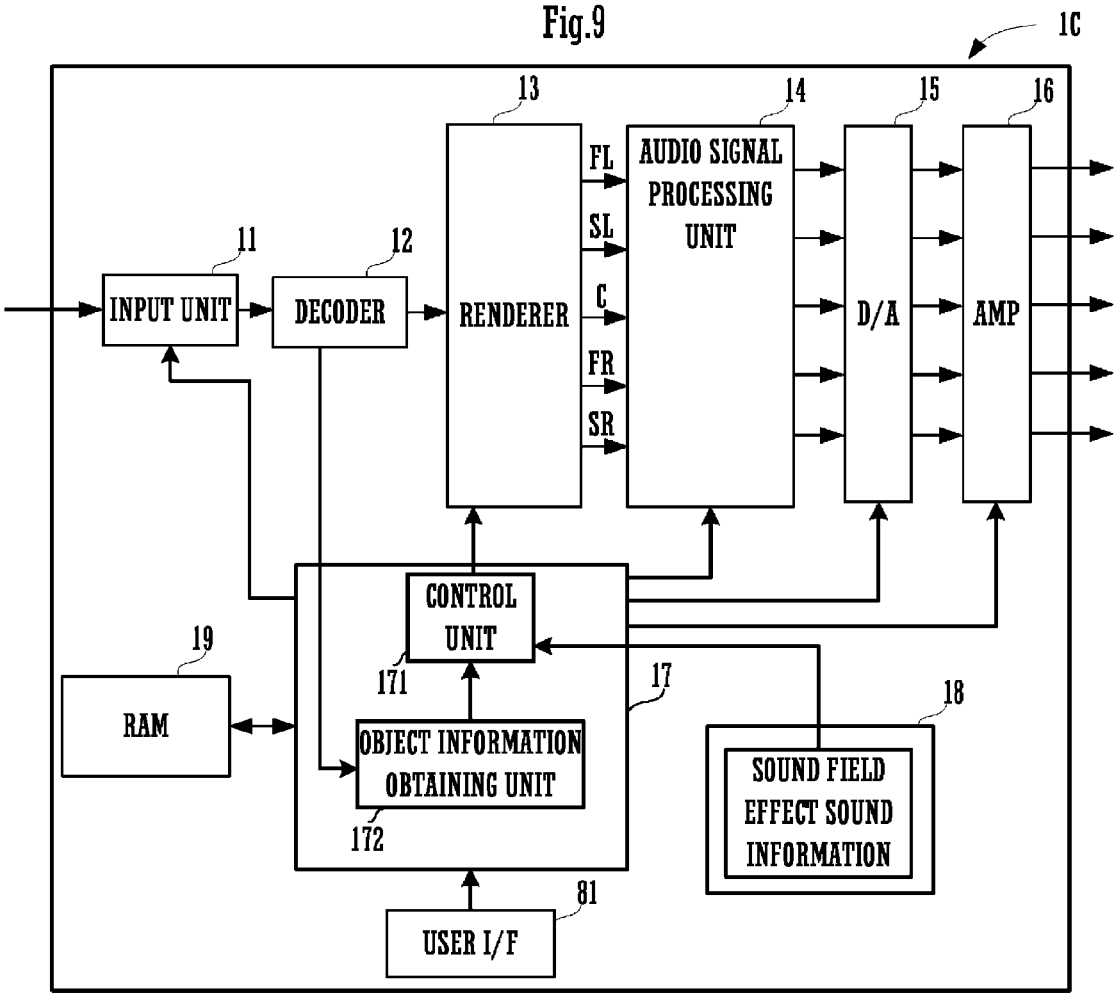
FIG. 9 is a block diagram of an audio signal processing apparatus according to the third preferred embodiment.

FIG. 8A and FIG. 8B are views illustrating a frame format of the listening environment according to the third preferred embodiment and FIG. 9 is a block diagram of an audio signal processing apparatus 1C according to the third preferred embodiment. The audio signal processing apparatus 1C according to the third preferred embodiment includes a hardware configuration similar to the hardware configuration of the audio signal processing apparatus 1 shown in FIG. 2 and further includes a user interface (I/F) 81 as a receiving unit.

The user I/F 81 is an interface that receives an operation from a user and includes a switch that is installed on a housing of the audio signal processing apparatus, a touch panel, or a remote control. The user specifies a desired acoustic space as a change command to change the listening environment via the user I/F 81.

The control unit 171 of the CPU 17 receives a specification of the acoustic space and reads sound field effect information corresponding to the acoustic space specified from the ROM 18. Then, the control unit 171 sets a filter coefficient based on the sound field effect information, a distribution ratio to each of the channels, and the like, to the audio signal processing unit 14.

Furthermore, the control unit 171 rearranges the object by converting the position information of the object obtained in the object information obtaining unit 172 into a position corresponding to the read sound field effect information and outputting the converted position information to the renderer 13.

In other words, the control unit 171, in a case of receiving the specification of the acoustic space of a large concert hall, for example, rearranges the object to a position far away from the listening position so as to rearrange each object to a position corresponding to the scale of the large concert hall. The renderer 13 performs a sound image localization process based on the position information input from the control unit 171.

For example, as shown in FIG. 8A, in a case in which an object 51R is arranged on the front right side of the listening position and an object 51L is arranged on the front left side of the listening position, the control unit 171, as shown in FIG. 8B, in a case of receiving the specification of the acoustic space of the large concert hall, rearranges the object 51R and the object 51L to positions far away from the listening position. Thus, not only the sound field environment of the selected acoustic space but also the position of the sound source corresponding to a direct sound can be made closer to an actual acoustic space.

The control unit 171 also converts the movement of the object into an amount of movement corresponding to the scale of the selected acoustic space. For example, in a theatrical performance and such, a performer speaks a line while moving dynamically. The control unit 171, in the case of receiving the specification of the acoustic space of the large concert hall, for example, makes the amount of movement of the object extracted in the decoder 12 larger and rearranges the position of the object corresponding to the performer. This allows the audience to experience a sense of presence or reality as if the performer performs on the spot.

In addition, the user I/F 81 can receive the specification of the listening position as a change command to change the listening environment. The user, after selecting a large hall as the acoustic space, for example, further selects a listening position, in the hall, such as a position immediately in front of the stage, a second floor seat (a position overlooking the stage from the obliquely upper side), and a position far from the stage and close to an exit.

The control unit 171 rearranges each object according to the specified listening position. For example, in a case in which the listening position at a position immediately in front of the stage is specified, the control unit 171 rearranges the object to a position close to the listening position, and, in a case in which the listening position at a position far from the stage is specified, rearranges the object to a position far from the listening position. In addition, for example, in a case in which a position of the second floor seat (a position overlooking the stage from the obliquely upper side) is specified as the listening position, the control unit 171 rearranges the object to an oblique position as viewed from the listener.

Moreover, the control unit 171, in a case of receiving the specification of the listening position, may preferably measure an actual sound field at each position (an arrival timing and a direction of an indirect sound) and may preferably store the sound field in the ROM 18 as the sound field effect information. The control unit 171 reads the sound field effect information corresponding to the specified listening position from the ROM 18. This can reproduce the sound field at the position immediately in front of the stage, the sound field at the position far from the stage, and the like.

It is to be noted that the sound field effect information does not need to be measured at all positions in the actual acoustic space. For example, the direct sound is increased at the position immediately in front of the stage and the indirect sound is increased at the position far from the stage. Thus, for example, in a case in which the listening position in the center of the hall is selected, the sound field effect information corresponding to the listening position in the center of the hall can be also interpolated by averaging the sound field effect information corresponding to a measurement result at the position immediately in front of the stage and the sound field effect information corresponding to a measurement result at the position far from the stage.

APPLICATION EXAMPLE

Figure 14:
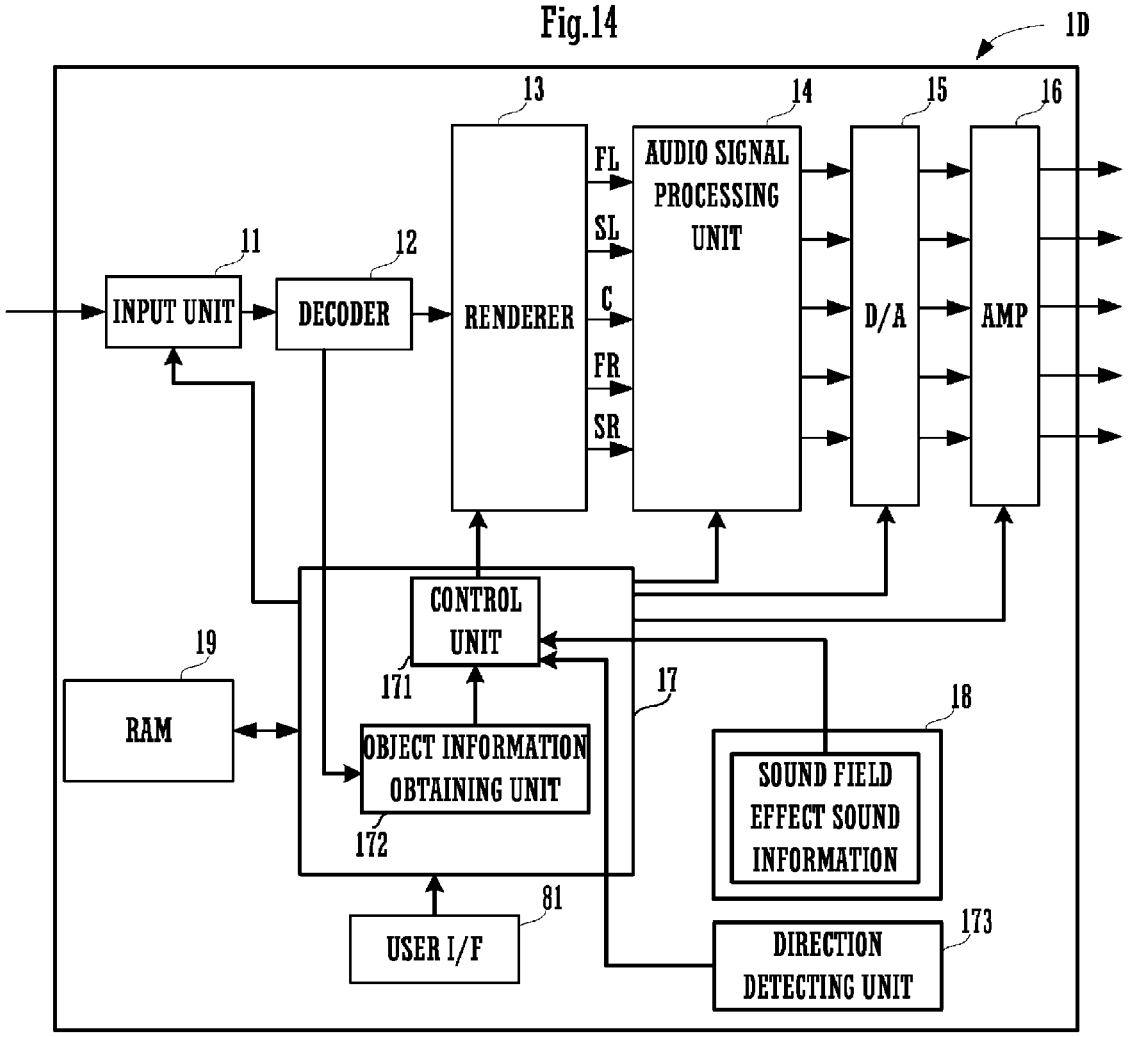
FIG. 14 is a block diagram of an audio signal processing apparatus according to an application example.

FIG. 14 is a block diagram of an audio signal processing apparatus 1D according to an application example. The audio signal processing apparatus 1D according to the application example obtains information with regard to a direction to which a listener faces by using a direction detecting unit 173 such as a gyro sensor installed in a terminal mounted on the listener. The control unit 171 rearranges each object according to the direction to which the listener faces.

For example, the control unit 171, in a case in which the listener faces the right side, rearranges the object to a position on the left side as viewed from the listener.

In addition, the ROM 18 of the audio signal processing apparatus 1D according to the application example stores sound field effect information for each direction. The control unit 171 reads the sound field effect information from the ROM 18 according to the direction to which the listener faces and sets the sound field effect information to an audio signal processing unit 14. This allows the listener to obtain a feeling of reality as if the listener is at the place.

Figure 12:
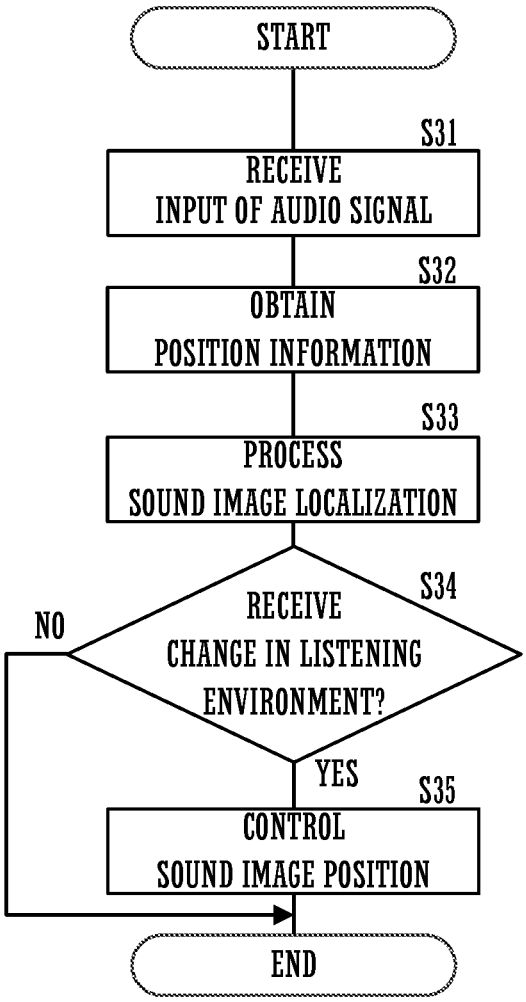
FIG. 12 is a flow chart showing the operation of the audio signal processing apparatus.

FIG. 12 is a flow chart showing the operation of the audio signal processing apparatus. First, the audio signal processing apparatus receives the input of an audio signal (S31). As described above, in the case in which the input unit 11 receives the input of content data from a player and the like, the decoder 12 decodes the content data and extracts an audio signal. The input unit 11, in the case of receiving the input of an analog audio signal, converts the analog audio signal into a digital audio signal. Then, the audio signal processing apparatus obtains position information (object information) (S32). The renderer 13 performs a sound image localization process (S33). Thereafter, in a case in which the user I/F 81 receives a change instruction to change the listening environment (S34), the control unit 171 controls a sound image localization position (S35) by outputting the position information obtained in the process of S32 to the renderer 13.

Figure 13:
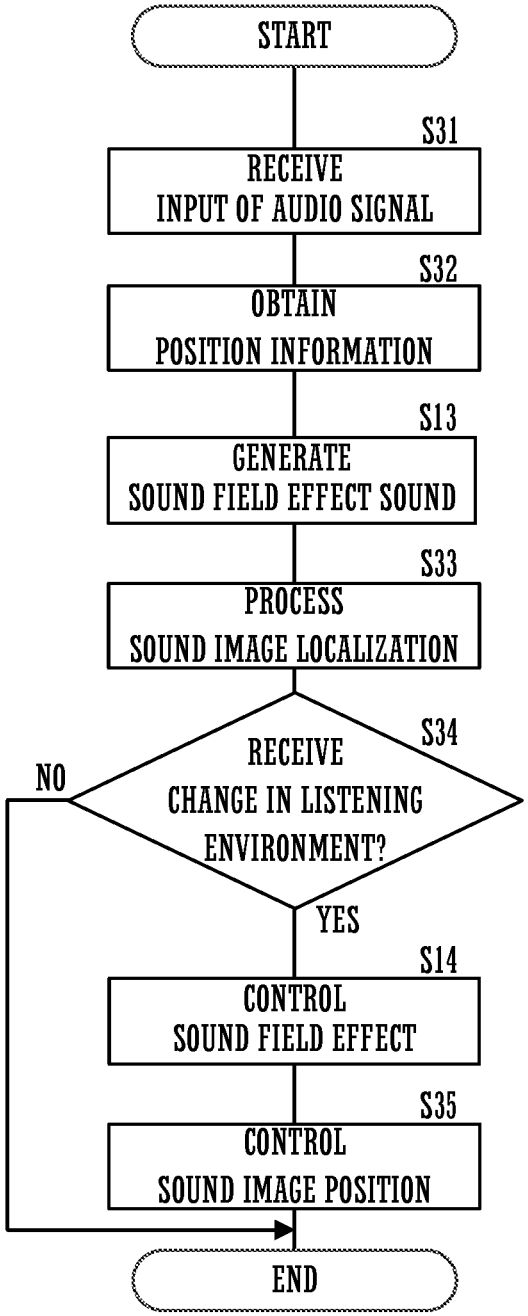
FIG. 13 is a flow chart showing the operation of the audio signal processing apparatus.

It should be noted that the first preferred embodiment, the second preferred embodiment, and the third preferred embodiment that have been described above can be properly combined. For example, as shown in FIG. 13, the audio signal processing apparatus, while performing the control of the sound field effect (S14) based on the position information, can also perform the control of the sound image localization position (S33) based on the position information. In addition, the position of the sound source based on the correlation component of each of the channels is estimated and, based on the estimated position of the sound source, the sound field effect may be controlled or the sound image localization of the sound source may be performed based on the estimated position of the sound source.

It is to be noted that the descriptions of the first preferred embodiment, the second preferred embodiment, or the third preferred embodiment that have been described above are illustrative in all points and should not be construed to limit the present invention. The scope of the present invention is shown not by the foregoing preferred embodiments but by the following claims. Further, the scope of the present invention is intended to include all modifications within the scopes of the claims and within the meanings and scopes of equivalents.

What is claimed is:

1. An audio signal processing apparatus comprising:

an input unit configured to receive input of audio signals of a plurality of channels;

an obtaining unit configured to obtain position information of a sound source;

a sound image localization processing unit configured to perform sound image localization of the sound source based on the position information;

a sound field effect sound generating unit configured to generate a sound field effect sound by individually imparting a sound field effect to an audio signal of each of the channels;

a control unit configured to:

control, based on the position information, the sound field effect to be imparted in the sound field effect sound generating unit, and control, according to a change command to change a listening environment, a sound image position of the sound image localization processing unit;

a converter configured to convert the generated sound field effect sound associated with each of the channels; and an amplifier configured to amplify the converted sound field effect sound of each of the channels and output to respective speaker units.

2. The audio signal processing apparatus according to claim 1, wherein:

the sound field effect sound generating unit generates the sound field effect sound by combining the audio signals of the channels with a predetermined gain; and the control unit controls the gain of each of the channels in the sound field effect sound generating unit based on the position information.

3. The audio signal processing apparatus according to claim 1, wherein:

the sound field effect sound generating unit comprises a first sound field effect sound generating unit and a second sound field effect sound generating unit;

the first sound field effect sound generating unit performs a process of generating the sound field effect sound by individually imparting the sound field effect to the audio signal of each of the channels based on a predetermined parameter; and the second sound field effect sound generating unit, based on a control of the control unit, performs a process of individually imparting the sound field effect to the audio signal of each of the channels.

4. The audio signal processing apparatus according to claim 1, wherein:

the obtaining unit obtains the position information of the sound source for each band; and the control unit sets a parameter in the sound field effect sound generating unit based on the position information of the sound source for each band.

5. The audio signal processing apparatus according to claim 1, further comprising a correlation detecting unit configured to detect a correlation component between the channels, wherein the obtaining unit, based on the correlation component detected by the correlation detecting unit, obtains the position information of the sound source.

6. The audio signal processing apparatus according to claim 1, wherein the obtaining unit, from content data corresponding to the audio signal, obtains the position information of the sound source.

7. The audio signal processing apparatus according to claim 1, further comprising:

a receiving unit configured to receive the change command to change the listening environment.

8. The audio signal processing apparatus according to claim 1, wherein:

the obtaining unit further obtains information indicating a type of the sound source; and the control unit, based on the information indicating the type of the sound source, sets a different gain for each type of the sound source.

9. The audio signal processing apparatus according to claim 5, further comprising a band dividing unit configured to divide each of the audio signals of the plurality of channels for each predetermined band, wherein the correlation detecting unit detects the correlation component for each band.

10. The audio signal processing apparatus according to claim 5, further comprising a level detecting unit configured to detect a level of each of divided bands, wherein the obtaining unit obtains information on a type of the sound source based on the level of each of the divided bands.

11. The audio signal processing apparatus according to claim 7, further comprising a storage unit configured to store sound field effect information for each listening position, the sound field effect information being used for imparting the sound field effect to the audio signal, wherein:

the receiving unit receives setting of the listening position as the change command to change the listening environment; and the control unit reads the sound field effect information from the storage unit according to the setting of the listening position received by the receiving unit, and sets the sound field effect information to the sound field effect sound generating unit.

12. The audio signal processing apparatus according to claim 11, wherein the control unit reads out a plurality of pieces of the sound field effect information stored in the storage unit and interpolates the sound field effect information of the listening position corresponding to each of the pieces of the sound field effect information that has been read out.

13. The audio signal processing apparatus according to claim 7, further comprising a direction detecting unit configured to detect a direction to which a listener faces, wherein the control unit controls the sound image position of the sound image localization processing unit according to the direction to which the listener faces that has been detected in the direction detecting unit.

14. A method of processing an audio signal, the method comprising:

an input step of receiving input of audio signals of a plurality of channels;

an obtaining step of obtaining position information of a sound source;

a sound image localization processing step of performing sound image localization of the sound source based on the position information;

a sound field effect sound generating step of generating a sound field effect sound by individually imparting a sound field effect to an audio signal of each of the channels; and a control step of controlling, based on the position information, the sound field effect to be imparted in the sound field effect sound generating step;

a control step of controlling, according to a change command to change a listening environment, a sound image position in the sound image localization processing step;

a converting step of converting the generated sound field effect sound associated with each of the channels; and an amplifying step of amplifying the converted sound field effect sound of each of the channels and output to respective speaker units.

15. The method of processing an audio signal according to claim 14, further comprising a correlation detecting step of detecting a correlation component between the channels, wherein, in the obtaining step, based on the correlation component detected in the correlation detecting step, the position information of the sound source is obtained.

16. The method of processing an audio signal according to claim 14, further comprising:

a receiving step of receiving the change command to change the listening environment.

* * * * *